US007134462B2

(12) United States Patent
Liu

(10) Patent No.: US 7,134,462 B2
(45) Date of Patent: Nov. 14, 2006

(54) ROTARY CUTTER FOR A WOOD PLANING MACHINE

(75) Inventor: Chin-Yuan Liu, Taichung (TW)

(73) Assignee: Shinmax Industry Co., Ltd., Taichung Hsien (TW)

( * ) Notice: Subject to any disclaimer, the term of this patent is extended or adjusted under 35 U.S.C. 154(b) by 0 days.

(21) Appl. No.: 11/372,942

(22) Filed: Mar. 9, 2006

(65) Prior Publication Data

US 2006/0151065 A1 Jul. 13, 2006

Related U.S. Application Data

(63) Continuation-in-part of application No. 10/986,637, filed on Nov. 12, 2004, now abandoned.

(51) Int. Cl.
*B27C 1/00* (2006.01)

(52) U.S. Cl. ..... 144/117.1; 144/174; 144/230; 241/92

(58) Field of Classification Search ..... 144/218, 144/220, 221, 230, 172–174, 114.1, 117.1, 144/118; 407/34–37, 44–46, 53, 54; 241/92, 241/93, 296

See application file for complete search history.

(56) References Cited

U.S. PATENT DOCUMENTS 631,542 A * 8/1899 Ihle ..... 144/230
4,353,400 A * 10/1982 Flanigan et al. ..... 144/117.1
4,628,976 A * 12/1986 Loring ..... 144/241

* cited by examiner

*Primary Examiner*—Lowell A. Larson
*Assistant Examiner*—Shelley Self
(74) *Attorney, Agent, or Firm*—Frommer Lawrence & Haug LLP; Ronald R. Santucci

(57) ABSTRACT

A rotary cutter of a wood planing machine includes: a rotary shaft that has alternately disposed fan-shaped vanes and fan-shaped grooves; and blades secured respectively to the fan-shaped vanes. Each of the fan-shaped vanes has a leading face and a trailing face. Each of the blades is attached securedly to the trailing face of the respective fan-shaped vane. The leading face of each of the fan-shaped vanes and the trailing face of an adjacent one of the fan-shaped vanes converge toward a center portion of the rotary shaft so as to define a respective one of the fan-shaped grooves, and cooperatively define an angle therebetween. The angle is greater than 60 degrees and less than 120 degrees.

8 Claims, 6 Drawing Sheets

ROTARY CUTTER FOR A WOOD PLANING MACHINE

CROSS-REFERENCE TO RELATED APPLICATION

This application is a continuation-in-part (CIP) of U.S. patent application Ser. No. 10/986,637, filed by the applicant on Nov. 12, 2004 now abandoned.

BACKGROUND OF THE INVENTION

1. Field of the Invention

This invention relates to a rotary cutter for a wood planing machine, more particularly to a rotary cutter including a rotary shaft with a fan-shaped cross-section.

2. Description of the Related Art

FIGS. 1 and 2 illustrate a conventional wood planing machine that includes a base 6, a worktable 7 mounted on the base 6 and adapted to support a workpiece 9 thereon, and a rotary cutter 8 mounted rotatably on the base 6 underneath the worktable 7. The rotary cutter 8 includes a shaft 80 that is formed with a plurality of recesses 801, and a plurality of blades 81, each of which is mounted securely on the shaft 80 and each of which is disposed in a respective one of the recesses 801.

The conventional wood planing machine is disadvantageous in that woodchips cut from the workpiece 9 cannot be removed smoothly and that the woodchips tend to accumulate on the rotary cutter 8 during a cutting operation, which has an adverse effect on cutting of the workpiece 9.

SUMMARY OF THE INVENTION

Therefore, the object of this invention is to provide a rotary cutter for a wood planing machine that is capable of overcoming the aforesaid drawback of the prior art.

According to the present invention, a rotary cutter for a wood planing machine includes: an elongated rotary shaft that has a fan-shaped cross-section, a center portion, and a plurality of fan-shaped vanes angularly displaced around the center portion and extending transversely and outwardly from the center portion, and that is formed with a plurality of fan-shaped grooves, each of which is defined by two adjacent ones of the fan-shaped vanes; and a plurality of elongated blades, each of which is secured to a respective one of the fan-shaped vanes within a respective one of the fan-shaped grooves. Each of the fan-shaped vanes has a free end that is distal from the center portion of the rotary shaft and that has an end face with a leading edge and a trailing edge opposite to the leading edge, a leading face that extends from the leading edge to the center portion and that faces in a forward direction relative to a rotational direction of the rotary shaft, and a trailing face that extends from the trailing edge to the center portion and that faces in a backward direction relative to the rotational direction of the rotary shaft. Each of the blades is attached securedly to the trailing face of the respective one of the fan-shaped vanes. The leading face of each of the fan-shaped vanes and the trailing face of an adjacent one of the fan-shaped vanes converge toward the center portion of the rotary shaft so as to define a respective one of the fan-shaped grooves, and cooperatively define an angle therebetween. The angle is greater than 60 degrees and less than 120 degrees.

BRIEF DESCRIPTION OF THE DRAWINGS

Other features and advantages of the present invention will become apparent in the following detailed description of the preferred embodiment of the invention, with reference to the accompanying drawings. In the drawings.

DETAILED DESCRIPTION OF THE PREFERRED EMBODIMENT

Figure 1:
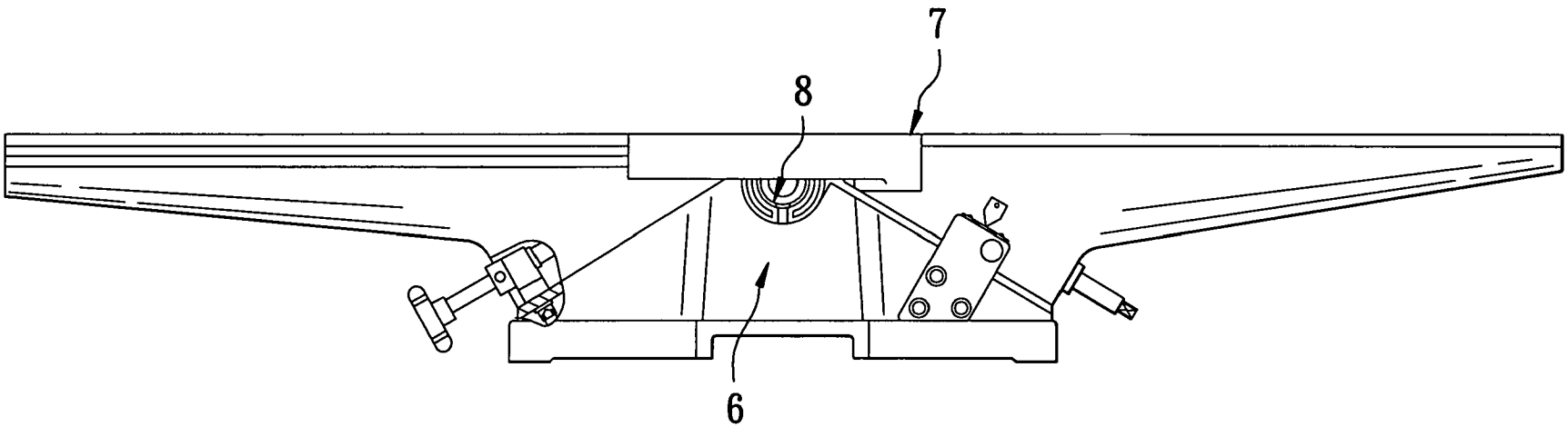
FIG. 1 PRIOR ART
FIG. 1 is a schematic view of a conventional wood planing machine.
Figure 2:
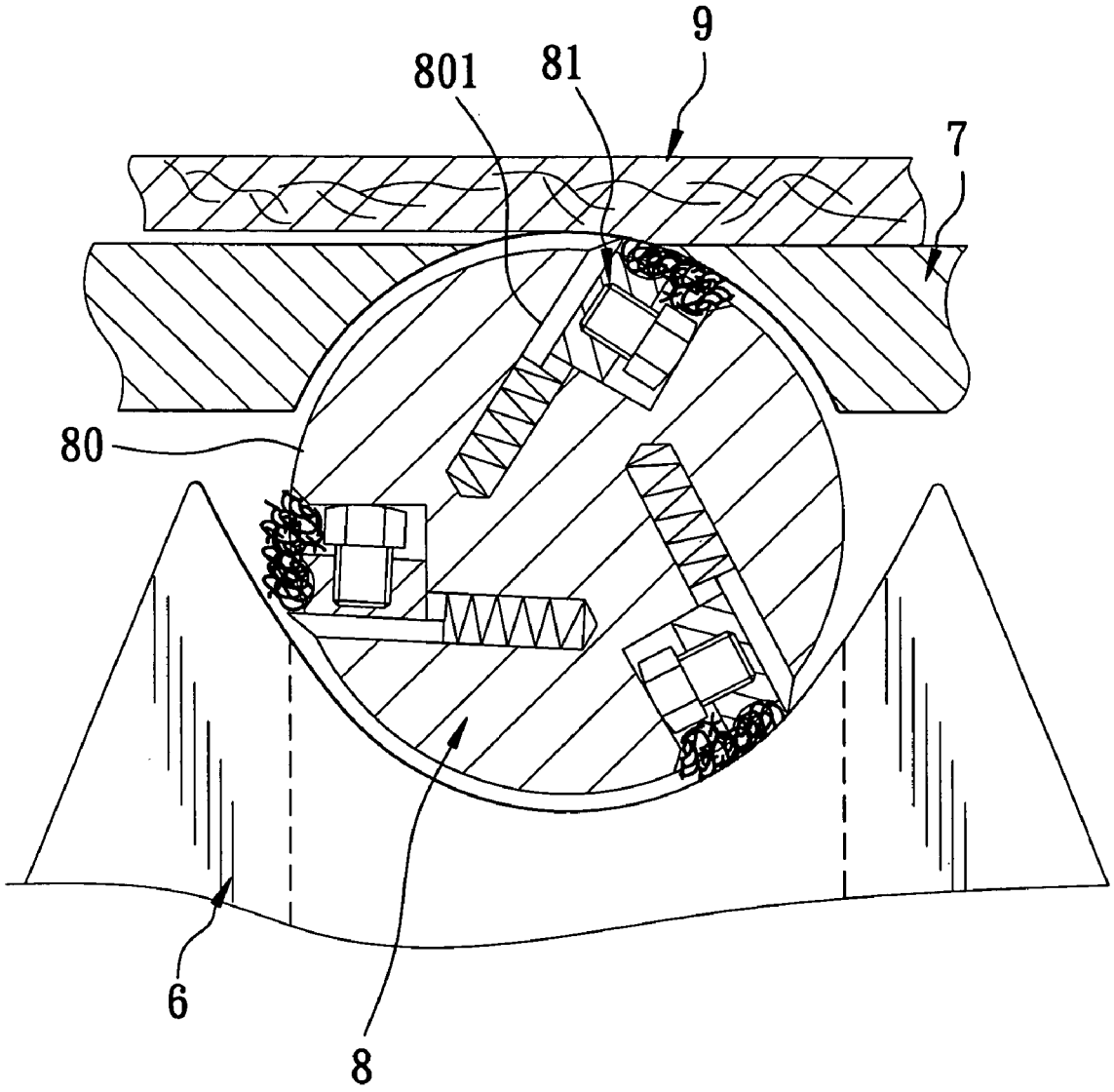
FIG. 2 PRIOR ART
FIG. 2 is a fragmentary sectional view of a rotary cutter of the conventional wood planing machine of FIG. 1.
Figure 3:
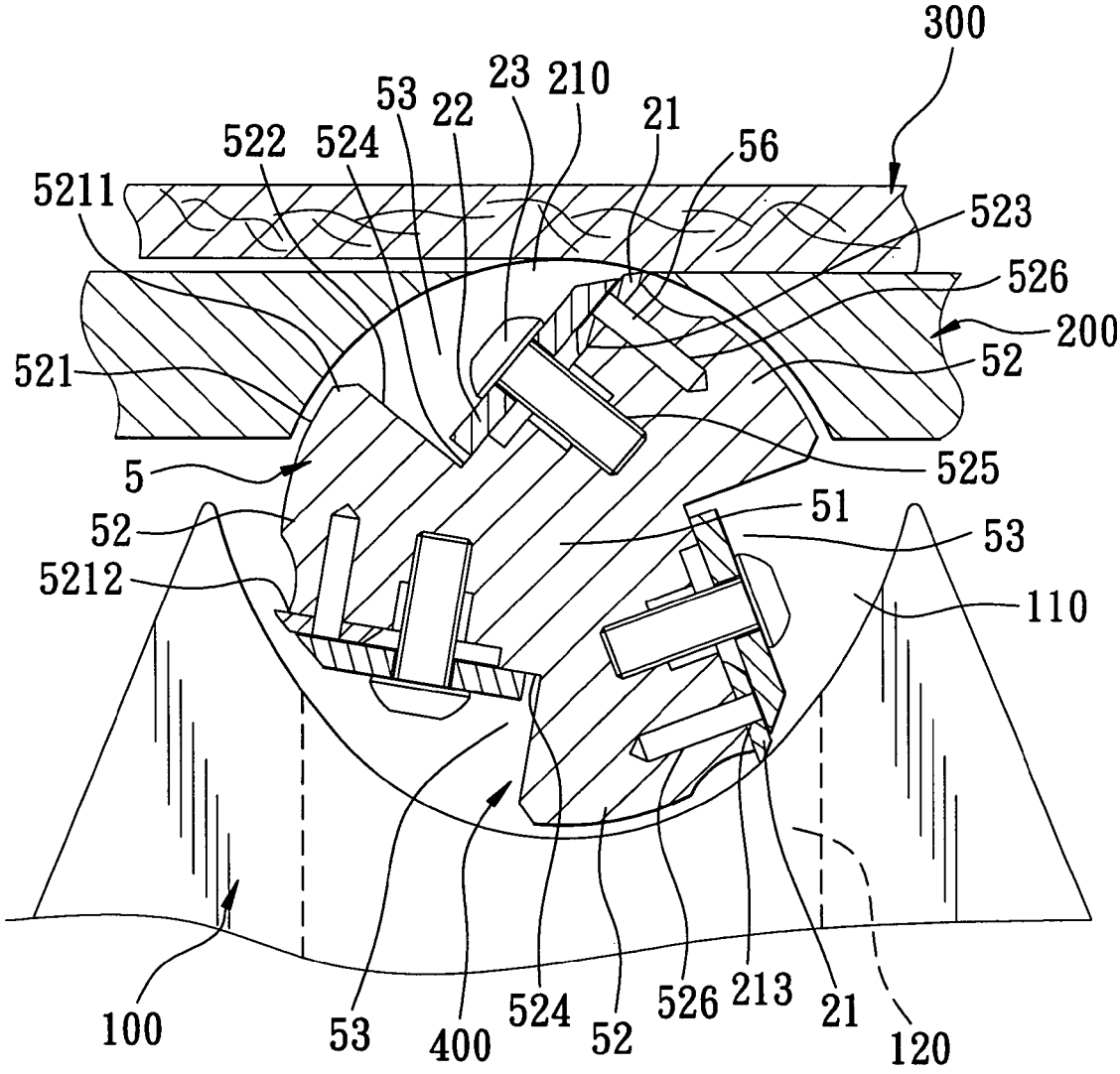
FIG. 3 is a fragmentary sectional view of the preferred embodiment of a wood planing machine according to this invention.
Figure 4:
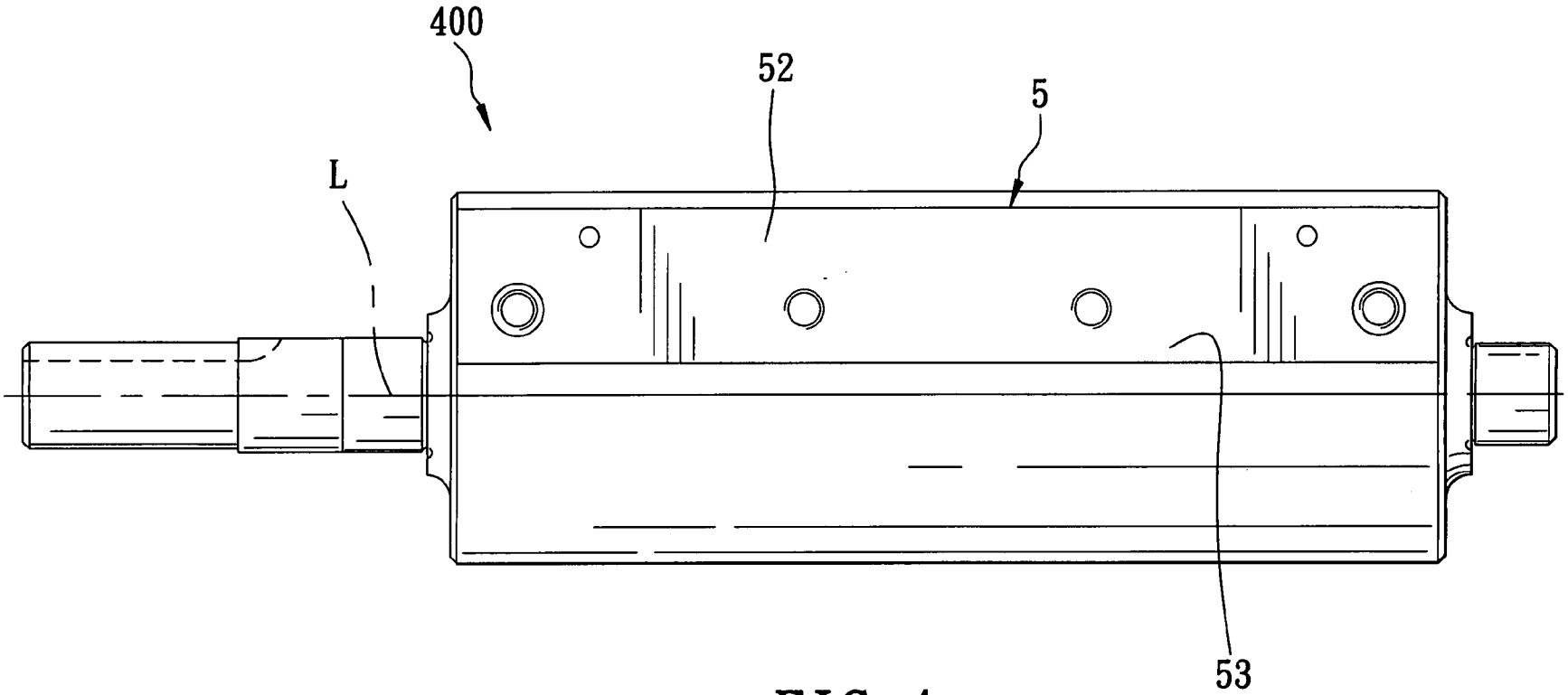
FIGS. 4 and 5 are schematic views to illustrate the configuration of fan-shaped grooves in a rotary cutter of the preferred embodiment.

FIGS. 3 to 6 illustrate the preferred embodiment of a wood planing machine according to this invention.

The wood planing machine includes: a base 100; a worktable 200 adapted to support a workpiece 300 thereon, mounted on and cooperating with the base 100 to define a cutter-accommodating space 110 therebetween, and formed with an elongated opening 210 that is in spatial communication with the cutter-accommodating space 110 and that defines a cutting site thereabove; and a rotary cutter 400 mounted rotatably in the cutter-accommodating space 110 and including an elongated rotary shaft 5 that has a fan-shaped cross-section, a center portion 51, and a plurality of fan-shaped vanes 52 angularly displaced around the center portion 51 and extending transversely and outwardly from the center portion 51, and that is formed with a plurality of fan-shaped grooves 53, each of which is defined by two adjacent ones of the fan-shaped vanes 52, so as to provide a blowing effect on the cutting site and so as to facilitate removal of woodchips cut from the workpiece 300 at the cutting site, and a plurality of elongated blades 21, each of which is secured to a respective one of the fan-shaped vanes 52 within a respective one of the fan-shaped grooves 53.

In this embodiment, each of the fan-shaped vanes 52 has a free end 521 that is distal from the center portion 51 of the rotary shaft 5 and that has an end face with a leading edge 5211 and a trailing edge 5212 opposite to the leading edge 5211, a leading face 522 that extends from the leading edge 5211 to the center portion 51 and that faces in a forward direction relative to a rotational direction (X) of the rotary shaft 5 (see FIG. 5), and a trailing face 523 that extends from the trailing edge 5212 to the center portion 51 and that faces in a backward direction relative to the rotational direction (X) of the rotary shaft 5.

Figure 5:
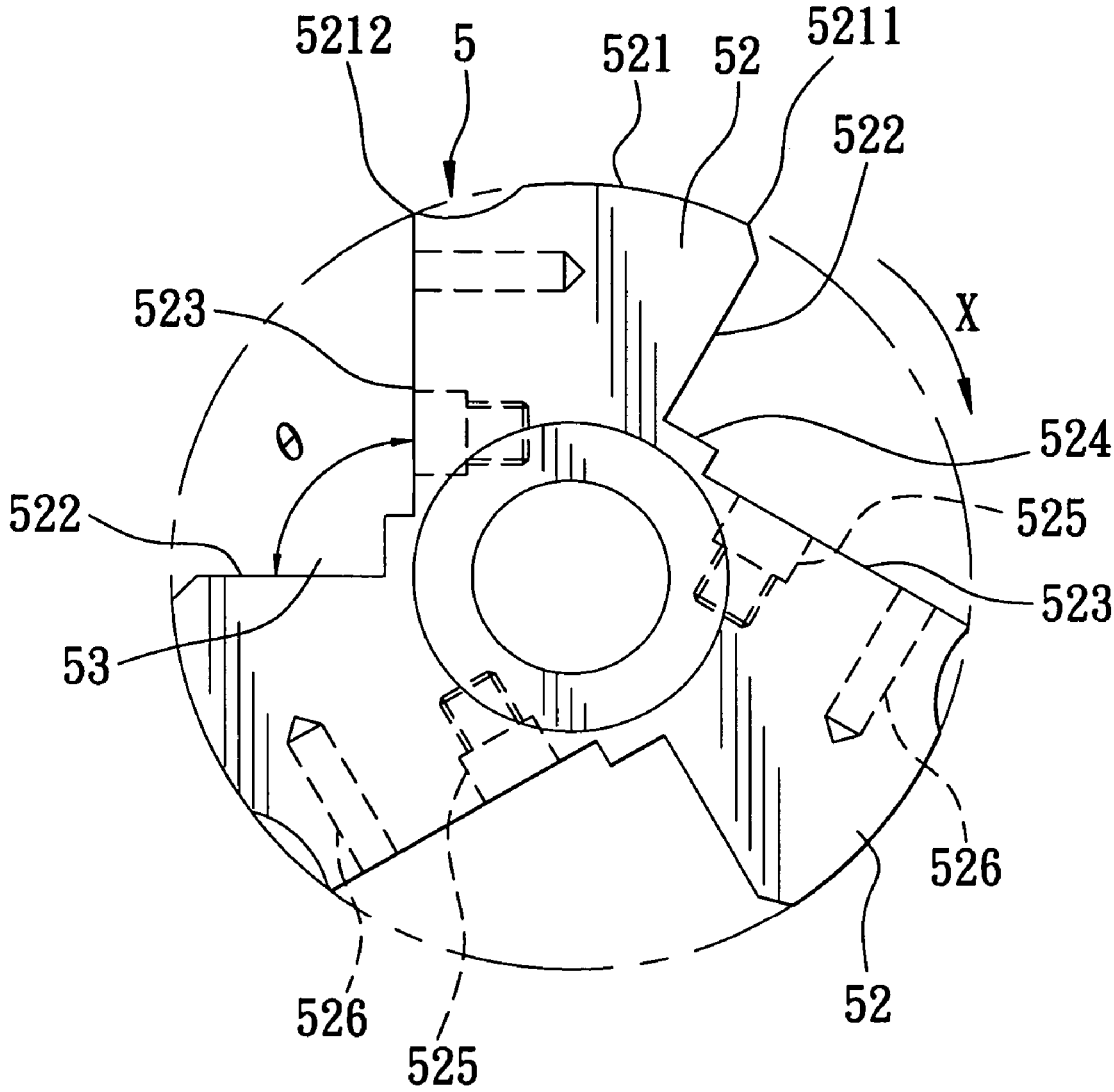

The leading face 522 of each of the fan-shaped vanes 52 and the trailing face 523 of an adjacent one of the fan-shaped vanes 52 converge toward the center portion 51 of the rotary shaft 5 so as to define a respective one of the fan-shaped grooves 53, and cooperatively define an angle (θ) therebetween (see FIG. 5). Preferably, the angle (θ) is greater than 60 degrees and less than 120 degrees. More preferably, the angle (θ) is 90 degrees, and the leading face 522 of each of the fan-shaped vanes 52 extends along a plane that passes through a rotation axis (L) (see FIG. 4) of the rotary shaft 5 so as to provide a better blowing effect on the cutting site.

Each of the blades 21 is attached securedly to the trailing face 523 of the respective one of the fan-shaped vanes 52 through a pressing plate 22, fasteners 23 (which are in the form of screws), and blade-mounting pins 56. The trailing face 523 of each of the fan-shaped vanes 52 is formed with a step 524 (see FIG. 5) extending along the length of the respective fan-shaped vane 52. Each of the fan-shaped vanes 52 is formed with a plurality of pin holes 526 aligned along the length of the respective fan-shaped vane 52 and indented inwardly from the trailing face 523, and a plurality of screw holes 525 aligned along the length of the respective fan-shaped vane 52, indented inwardly from the trailing face 523, and disposed between the step 524 and an imaginary line defined by the pin holes 526 on the respective fan-shaped vane 52. The blade-mounting pins 56 are fitted into the pin holes 526, respectively. Each of the blade-mounting pins 56 has an end portion that extends outwardly of the respective pin hole 526 into the respective fan-shaped groove 53. Each of the blades 21 is formed with a plurality of mounting holes 213 (see FIG. 3) for extension of the end portions of the blade-mounting pins 56 thereinto, respectively. The pressing plate 22 abuts tightly against the step 524 on the respective fan-shaped vane 52 and the respective blade 21 by extending the fasteners 23 into the respective screw holes 525 and by fastening the fasteners 23 to the respective fan-shaped vane 52.

Figure 6:
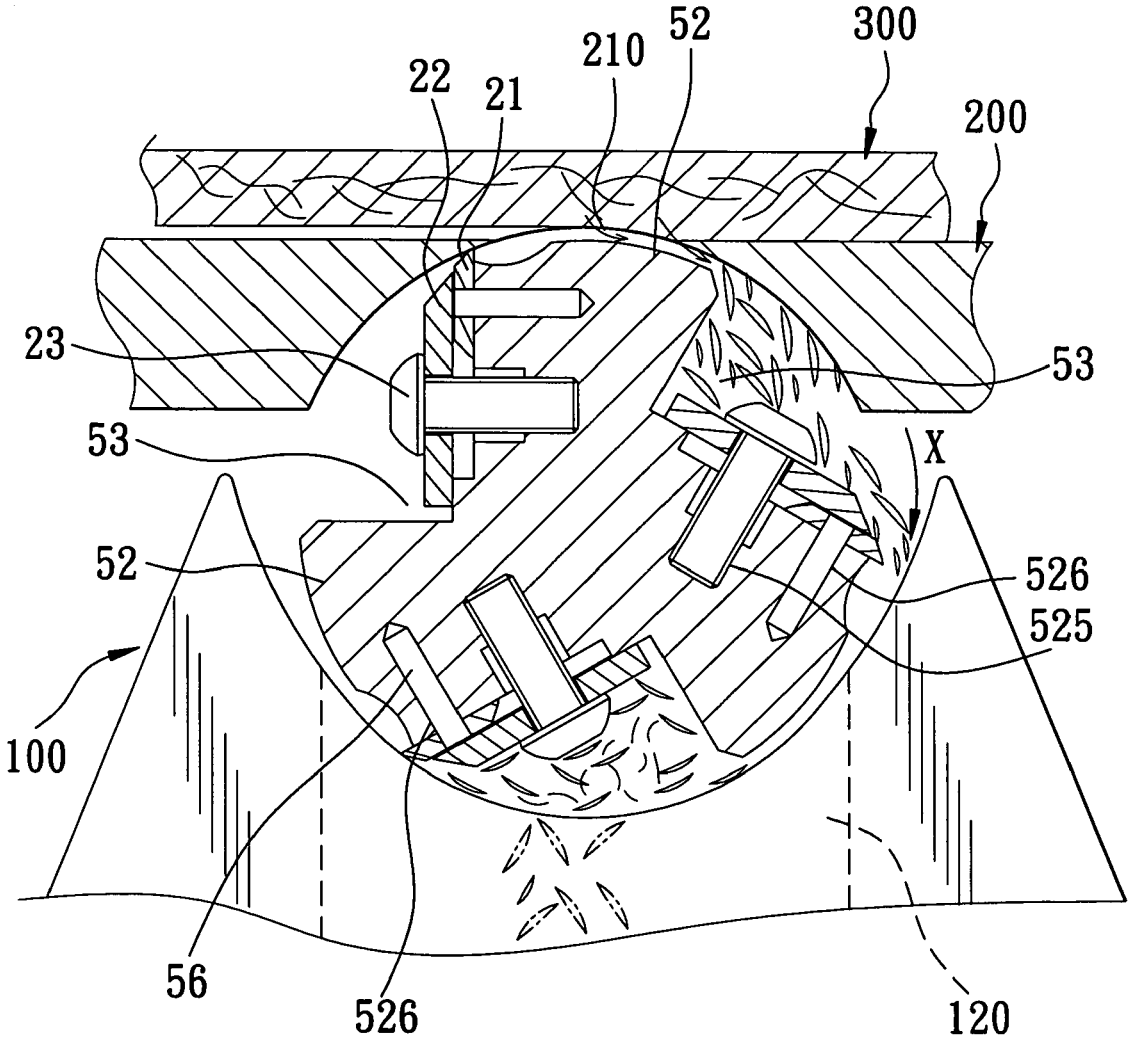
FIG. 6 is a fragmentary sectional view to illustrate how woodchips cut from a workpiece are removed by an air stream resulting from rotation of the rotary cutter of the preferred embodiment.

Referring to FIG. 6, during a cutting operation, the woodchips cut from the workpiece 300 are blown by an air stream resulting from rotation of the rotary shaft 5, and fall into an adjacent one of the fan-shaped grooves 53. The woodchips are subsequently discharged to a collector (not shown) through a channel 120 (see FIGS. 3 and 6) in the base 100 by virtue of gravity when the fan-shaped grooves 53 move to a lower position.

With the inclusion of the fan-shaped vanes 52 and the fan-shaped grooves 53 in the rotary cutter 400 of the preferred embodiment, removal of woodchips during a cutting operation can be facilitated, and the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A rotary cutter for a wood planing machine, comprising:

an elongated rotary shaft that has a fan-shaped cross-section, a center portion, and a plurality of fan-shaped vanes angularly displaced around said center portion and extending transversely and outwardly from said center portion, and that is formed with a plurality of fan-shaped grooves, each of which is defined by two adjacent ones of said fan-shaped vanes; and a plurality of elongated blades, each of which is secured to a respective one of said fan-shaped vanes within a respective one of said fan-shaped grooves;

wherein each of said fan-shaped vanes has a free end that is distal from said center portion of said rotary shaft and that has an end face with a leading edge and a trailing edge opposite to said leading edge, a leading face that extends from said leading edge to said center portion and that faces in a forward direction relative to a rotational direction of said rotary shaft, and a trailing face that extends from said trailing edge to said center portion and that faces in a backward direction relative to the rotational direction of said rotary shaft, each of said blades being attached securedly to said trailing face of the respective one of said fan-shaped vanes; and wherein said leading face of each of said fan-shaped vanes and said trailing face of an adjacent one of said fan-shaped vanes converge toward said center portion of said rotary shaft so as to define a respective one of said fan-shaped grooves, and cooperatively define an angle therebetween, said angle being greater than 60 degrees and less than 120 degrees.

2. The rotary cutter of claim 1, wherein said angle is 90 degrees, said leading face of each of said fan-shaped vanes extending along a plane that passes through a rotation axis of said rotary shaft.

3. The rotary cutter of claim 1, further comprising a plurality of blade-mounting pins, each of said fan-shaped vanes being formed with a plurality of pin holes indented inwardly from said trailing face, each of said blade-mounting pins being fitted into a respective one of said pin holes, and having an end portion extending outwardly of the respective one of said pin holes into a respective one of said fan-shaped grooves, each of said blades being formed with a plurality of mounting holes, said end portion of each of said blade-mounting pins extending into a respective one of said mounting holes in a respective one of said blades.

4. The rotary cutter of claim 3, further comprising a plurality of fasteners and a plurality of pressing plates, each of said pressing plates being fastened to a respective one of said fan-shaped vanes and abutting tightly against a respective one of said blades through said fasteners.

5. A wood planing machine comprising:

a base;

a worktable adapted to support a workpiece thereon, mounted on and cooperating with said base to define a cutter-accommodating space therebetween, and formed with an elongated opening that is in spatial communication with said cutter-accommodating space and that defines a cutting site thereabove; and a rotary cutter mounted rotatably in said cutter-accommodating space and including an elongated rotary shaft that has a fan-shaped cross-section, a center portion, and a plurality of fan-shaped vanes angularly displaced around said center portion and extending transversely and outwardly from said center portion, and that is formed with a plurality of fan-shaped grooves, each of which is defined by two adjacent ones of said fan-shaped vanes, so as to provide a blowing effect on said cutting site and so as to facilitate removal of woodchips cut from the workpiece at said cutting site, and a plurality of elongated blades, each of which is secured to a respective one of said fan-shaped vanes within a respective one of said fan-shaped grooves;

wherein each of said fan-shaped vanes has a free end that is distal from said center portion of said rotary shaft and that has an end face with a leading edge and a trailing edge opposite to said leading edge, a leading face that extends from said leading edge to said center portion and that faces in a forward direction relative to a rotational direction of said rotary shaft, and a trailing face that extends from said trailing edge to said center portion and that faces in a backward direction relative to the rotational direction of said rotary shaft, each of said blades being attached securedly to said trailing face of the respective one of said fan-shaped vanes; and wherein said leading face of each of said fan-shaped vanes and said trailing face of an adjacent one of said fan-shaped vanes converge toward said center portion of said rotary shaft so as to define a respective one of said fan-shaped grooves, and cooperatively define an angle therebetween, said angle being greater than 60 degrees and less than 120 degrees.

6. The wood planing machine of claim 5, wherein said angle is 90 degrees, said leading face of each of said fan-shaped vanes extending along a plane that passes through a rotation axis of said rotary shaft.

7. The wood planing machine of claim 5, further comprising a plurality of blade-mounting pins, each of said fan-shaped vanes being formed with a plurality of pin holes indented inwardly from said trailing face, each of said blade-mounting pins being fitted into a respective one of said pin holes, and having an end portion extending outwardly of the respective one of said pin holes into a respective one of said fan-shaped grooves, each of said blades being formed with a plurality of mounting holes, said end portion of each of said blade-mounting pins extending into a respective one of said mounting holes in a respective one of said blades.

8. The wood planing machine of claim 7, further comprising a plurality of fasteners and a plurality of pressing plates, each of said pressing plates being fastened to a respective one of said fan-shaped vanes and abutting tightly against a respective one of said blades through said fasteners.

* * * * *